US006189838B1

(12) United States Patent
Nicolette et al.

(10) Patent No.: US 6,189,838 B1
(45) Date of Patent: Feb. 20, 2001

(54) POSITION DETECTOR FOR TRACK MOUNTED SURVEILLANCE SYSTEMS

(75) Inventors: Thomas A. Nicolette, Centerport; Peter Y. Zhou, Smithtown; Lawrence Chao, Commack, all of NY (US)

(73) Assignee: Sentry Technology, Corp., Hauppauge, NY (US)

( * ) Notice: Under 35 U.S.C. 154(b), the term of this patent shall be extended for 0 days.

(21) Appl. No.: 09/089,462

(22) Filed: Jun. 2, 1998

(51) Int. Cl.[7] ..... B61L 23/00
(52) U.S. Cl. ..... 246/122 R
(58) Field of Search ..... 246/122 R, 122 A; 340/936, 988; 377/24.1, 24; 33/700, 772, 773

(56) References Cited

U.S. PATENT DOCUMENTS 3,792,533 * 2/1974 Plasser et al. ..... 33/144
4,532,710 * 8/1985 Kinney et al. ..... 33/141 E
4,862,486 * 8/1989 Wing et al. ..... 377/24.1
4,887,281 * 12/1989 Swanson ..... 377/24.1
5,003,704 * 4/1991 Schubert ..... 33/775
5,402,365 * 3/1995 Kozikaro et al. ..... 364/571.01

* cited by examiner

*Primary Examiner*—Mark T. Le
(74) *Attorney, Agent, or Firm*—Stroock & Stroock & Lavan LLP

(57) ABSTRACT

A mechanism for detecting the position of a carriage moveable along a track. The mechanism includes a wheel fixed to the carriage which rotates as the carriage moves along the track. A mark is disposed on a portion of the wheel. A detector is fixed to the carriage for sensing the mark as the wheel rotates and outputs a signal in response. A carriage processor receives the signal and determines the position of the carriage along the track.

8 Claims, 1 Drawing Sheet

POSITION DETECTOR FOR TRACK MOUNTED SURVEILLANCE SYSTEMS

BACKGROUND OF INVENTION

The present invention relates to a track mounted surveillance system, and in particular, to a mechanism for determining the position of a camera along the track of a track-mounted surveillance system.

Track mounted surveillance systems for remotely monitoring areas are known and widely used. An example of such a system is disclosed in U.S. Pat. No. 5,241,380 issued to Benson. Benson, which teaches a track mounted camera system adapted for surveillance of a large area, includes a carriage that is driven by a drive assembly longitudinally along a track assembly that is positioned along a selected path. A pair of electrically conductive tubes are mounted within but electrically isolated from and parallel to the track to provide power to the electric motor. Video cameras are mounted to the carriage for monitoring areas along the path. Output signals from the cameras are transmitted on the said conductive tubes to a remote monitoring location. Control signals for controlling placement of the carriage along the track are also transmitted on the same conductive tubes to the carriage.

It is desirable to position the camera at particular points along the track so that specific areas can be monitored. In Benson, this is accomplished by placing proximity sensors at various locations along the track so that when used in conjunction with switches, such as panic buttons, installed throughout the monitored area, the proximity sensors signal the system processor that the camera is adjacent to the desired location. By moving the carriage along the track until the appropriate proximity detector is activated, the camera can be positioned to particular points along the track.

A drawback of the prior art systems is that camera positioning is limited to the track positions adjacent the pre-installed proximity sensors. If it is desired to position the camera at a location that does not contain a proximity detector, an additional proximity detector must be installed at that location because the system has no other way to monitor the location of the camera along the track. As a result, the monitoring capabilities provided by the prior art systems are inflexible, overly complex in structure, and cannot easily be tailored to meet changing surveillance needs. Accordingly, it is advantageous to provide a mechanism which can detect the position of a camera at any point along the track of a track mounted surveillance so that the camera can be positioned at any desired location along the track.

SUMMARY OF THE INVENTION

The present invention is for a position detector mechanism for determining the position of a camera bearing carriage along a track mounted surveillance system. In accordance with the present invention, a mark is disposed on a portion of a wheel that is fixed to the carriage and which rotates to move the carriage along the track. A proximity detector is fixed to the carriage adjacent to the wheel. The proximity detector senses the mark as the wheel rotates as a result of carriage movement along the track and outputs a signal each time the mark is sensed. A position determinor receives the signal output by the proximity detector and determines the position of the carriage along the track based on the signal. Because the position of the carriage along the track can be determined, the carriage can be located to any desired location along the track.

Accordingly, it is an object of the present invention to provide a position detection mechanism so that the position of a carriage along a track can be determined.

Another object of the invention is to provide a surveillance camera which may be accurately positioned at any position along a path.

Still other objects and advantages of the invention will in part be obvious and will in part be apparent from the specification.

The invention accordingly comprises the features of construction combination of elements, an arrangement of parts which will be exemplified in the construction here and after set forth, and the scope of the invention will be indicated in the claims.

BRIEF DESCRIPTION OF THE DRAWINGS

For fuller understanding of the invention, reference is had to the following description taken in connection with the accompanying drawings, in which.

DETAILED DESCRIPTION OF THE PREFERRED EMBODIMENTS

Figure 1:
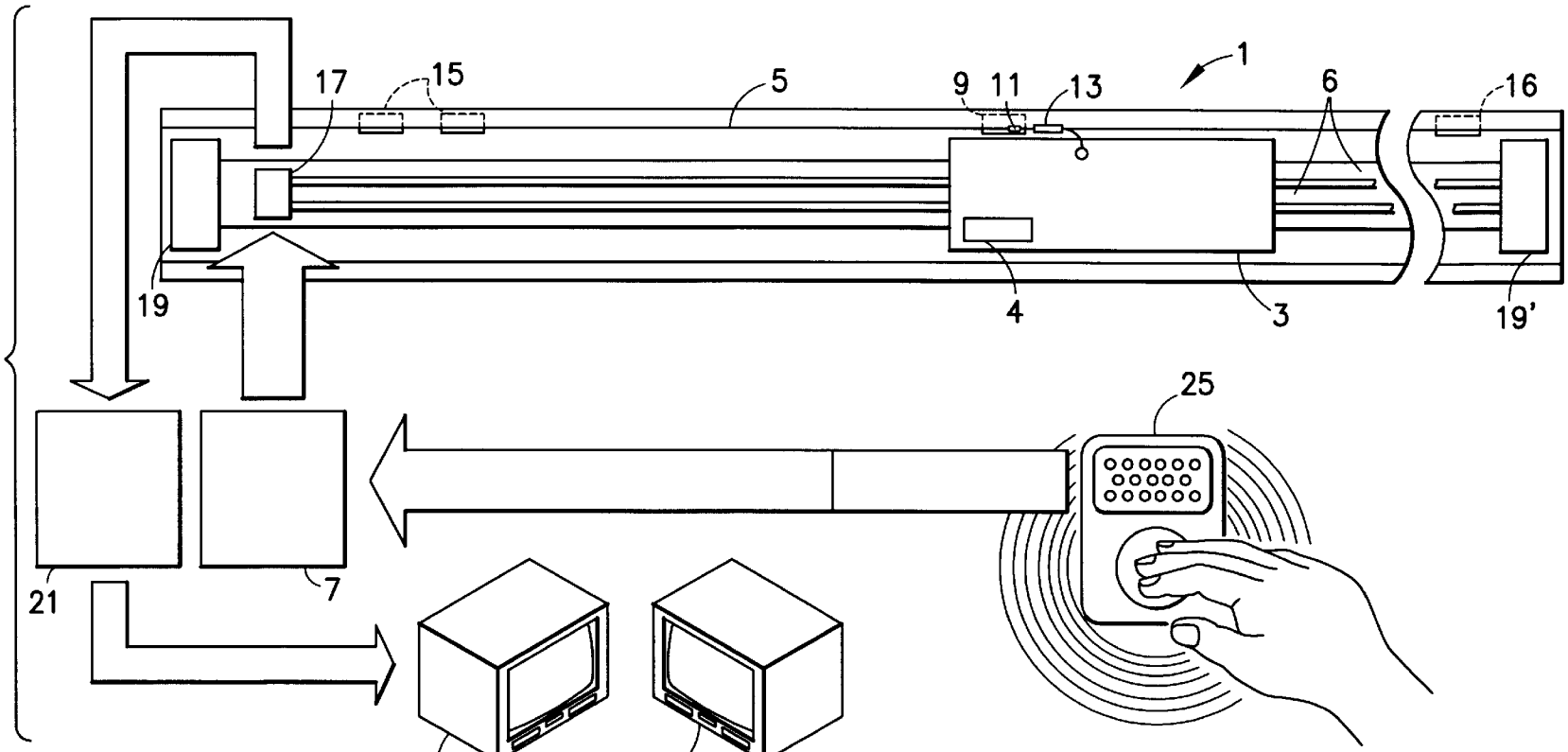
FIG. 1 is a side cross sectional view of a track mounted surveillance system constructed in accordance with the present invention.
Figure 2:
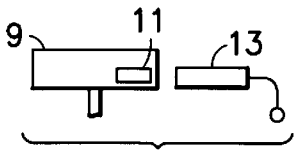
FIG. 2 is an expanded side view of the proximity detector of FIG. 1.

Referring now to FIGS. 1–2, there is shown a track mounted system 1 having a detection system 21 constructed in accordance with the present invention. Mounted system 1 includes a track 5 mounted on a wall or ceiling in the area to be monitored. A carriage 3 has a plurality of wheels (not shown) attached thereto and also contains a one or more cameras (not shown) used for monitoring as is known in the art. Carriage 3 is mounted on track 5 via the wheels for movement along track 5. At each end of track 5 is a bumper 19 for impeding the progress of carriage 3 as it reaches either end of track 5. A pair of electrically conducting copper signal rails 6 is mounted within but electrically isolated from and parallel to track 5.

A power source (not shown) is coupled to copper rails 6 for providing power to move carriage 3 along track 5 and to operate the camera. A control board 7 is connected to copper rails 6 through an RF adapter 17. Control board 7 transmits control signals to a carriage processor 4 on carriage 3 via copper rails 6 to direct carriage 3 to move in a particular direction and to a particular location along the track. Control board 7 receives signals from a plurality of panic buttons 25 installed throughout the monitored area. Video demodulator board 21 receives from carriage 3, via copper rails 6, output signals generated by the camera to a monitor 23. Because each signal is transmitted via copper rails 6 at a different frequency (frequency modulated), all signals can share copper rails 6 without interference.

An idler wheel 9 is one of the plurality of wheels fixed to carriage 3 for movement along track 5. A detectable identification mark 11 is placed on idler wheel 9. A detector 13 is mounted on carriage 3 adjacent idler wheel 9 which can sense the presence of identification mark 11 within the immediate spacial vicinity of the detector, which occurs once per revolution. Identification mark 11 may be positioned at any portion of idler wheel 9 as long as detector 13 detects identification mark 11 once per revolution of idler wheel 9. Similarly, detector 13 can be placed anywhere adjacent to idler wheel 9 on carriage 3 as long as it can accurately detect mark 11. For example, identification mark 11 can be positioned on the circumference of idler wheel 9. Each time identification mark 11 passes in front of detector 13 as a result of idler wheel 9 rotating, detector 13 detects the presence of identification mark 11 and transmits a position signal, corresponding to detection of mark 11, to processor 4 on carriage 3. In a preferred embodiment, mark 11 is on idler wheel 9, however it may be positioned on any wheel including the drive wheels of carriage 3.

In an exemplary embodiment, identification mark 11 is a magnet and detector 13 is a proximity sensor, and in particular, a Hall sensor that can detect the presence of magnetic flux during the passage of a magnet. An advantage of this embodiment is that proximity detector 13 does not have to be in physical contact with idler wheel 9 to sense identification mark 11 so that wear on proximity detector 13 is virtually eliminated.

In another embodiment, identification mark 11 is a hole extending through idler wheel 9 while proximity detector 13 includes a light source and light sensor. The light source is positioned on carriage 3 so that once each revolution of idler wheel 9 the light source shines through the hole. The light sensor, which is positioned on the opposite end of the hole, will detect when the light shines through the hole thus generating two position signals for each complete revolution of idler wheel 9.

In addition to these two embodiments, it will be obvious to one of ordinary skill in the art that other identification mark 11 and detector 13 pairs can be used to detect the rotation of idler wheel 9. Also, while the above embodiments are proximity detectors, i.e. the detector is not in contact with the mark, other detectors in which the mark and the detector are in contact may be used as well.

Carriage processor 4 receives the position signal output by proximity detector 13. Because proximity detector 13 outputs a known number of position signals after a full rotation of idler wheel 9, the receipt of the position signals indicates that carriage 3 advanced along track 5 a distance that equals the circumference of idler wheel 9. Based on this position signal, and knowing the starting position of carriage 3 and the history of directions in which carriage 3 has traveled, carriage processor 4 determines the position of carriage 3 on track 5. Carriage processor 4 transmits the location of carriage 3 to control board 7 via copper rails 6. Because carriage processor 4 can determine the exact location of carriage 3 along track 5, control board 7 can use this location information to command carriage processor to position carriage 3 at any desired location along track 5.

Because idler wheel 9 may slip along track 5 as carriage 3 moves, a full revolution of idler wheel 9 may not always correspond to carriage 3 moving a distance equal to the circumference of idler wheel 9. As a result, over time the position of carriage 3 calculated by carriage processor 4 may not reflect the actual position of carriage 3. To overcome these errors due to slippage, a pair of limit switches 15 are disposed at the end of track 5 that is adjacent the connection between control board 7 and copper rails 6. A single limit switch 16 is disposed at the other end of track 5. When carriage 3 is adjacent pair of limit switches 15, pair of limits switches 15 output a pair of limit signals to carriage processor 4. In response, carriage processor 4 "zeros out" the location of carriage: i.e. sets the position of carriage 3 to the end of track 5 adjacent connection to control board 7. When carriage 3 is adjacent single limit switch 16, a single limit signal is output to carriage processor 4 thereby setting the position of carriage 3 to the opposite end of track 5.

Limit switches 15, 16 may be a push button which physically contacts carriage 3 or a proximity detector which senses the presence of carriage 3 and outputs a signal to carriage processor 4 indicating the detection of carriage 3 adjacent limit switches 15 or 16. In this way, carriage processor 4 is notified of the precise position of carriage 3 at either end of track 5. The position of carriage 3 stored in carriage processor 4 is in effect "zeroed out" and any position errors previously accumulated are ignored.

The operation of position detector mechanism 21 will now be described. The first instant that carriage 3 is positioned at either end of track 5, either when track mounted system 1 first begins to operate or the first time carriage 3 reaches an end of track 5, the location of carriage 3 at the end of track 5 is communicated to carriage processor 4 via limit switches 15 or 16. This information is then communicated to control board 7 via rails 6. Thereafter, when carriage 3 moves along track 5 in response to control signals from control board 7, idler wheel 9 rotates and detector 13 senses identification mark 11 one or more times for each revolution of idler wheel 9. Detector 13 generates a position signal based on the sensing of identification mark 11 and outputs it to carriage processor 4.

Carriage processor 4 determines the new position of carriage 3 on track 5 by adding the distance traveled by carriage 3, that is equal to the number of position signals received by carriage processor 4 multiplied by the circumference of idler wheel 9, to the previous position of carriage 3. If carriage 3 begins moving in the opposite direction along track 5 as a result of controls signals output from control board 7, carriage processor 4 calculates the new position of carriage 3 on track 5 by subtracting the distance traveled from the previous position of carriage 3. When carriage 3 reaches limit switch pair 15 which is located at the end of track 5 adjacent control board 7, limit switch pair 15 outputs a pair of limit signals to carriage processor 4 indicating that carriage 3 is at that end of track 5 and carriage processor 4 will reset (or zero out) the position of carriage 3 along track 5 regardless the errors that have previously accumulated. Similarly, when carriage 3 reaches single limit switch 16, limit switch 16 outputs a single limit signal to carriage processor 4 indicating the position of carriage 3 is at the other end of track 5.

Accordingly, by using position detector mechanism 21 of the present invention, it is possible to accurately detect the position of carriage 3 moving along track 5 of track mounting system 1. By knowing the position of carriage 3 along track 5, it is possible to position carriage 3 to any desired location along track 5.

The ability to position carriage 3 to any location along track 5 overcomes the drawback in the prior art systems which require the placement of dedicated proximity sensors along track 5 adjacent each panic button 25 in order to move carriage 3 to a desired position along track 5. Instead, under the present invention, panic buttons may be positioned at any location throughout the monitored area without the need for a corresponding proximity sensor installed on track 5. When a panic button is activated, a signal is communicated to control board 7 and, in response, control board 7 directs carriage 3 to the position along track 5 adjacent the activated panic button.

It will thus be seen at the object set forth above, those made apparent from the preceding description, are efficiently attained and, because certain changes may be made in the above construction without departing from the spirit and scope of the invention, it is intended that all matter contained in the above description are shown in the accompanying drawings shall be interpreted as illustrative and not in a limiting sense.

It is also to be understood that the following claims are intended to cover all the generic and specific features of the invention herein described, and all statements of the scope of the invention which, as a matter of language, might be said to fall therebetween.

What is claimed is:

1. A mechanism comprising:

a track;

a carriage moveable along said track;

a wheel fixed to said carriage, said wheel rotating as said carriage moves along said track;

a mark disposed on a portion of said wheel;

a detector fixed to said carriage for sensing said mark as said wheel rotates and outputting a signal indicative of said mark being sensed by said detector;

a carriage processor for receiving said signal and determining the position of said carriage along said track; and at least one limit switch disposed at a predetermined position on the track, said at least one limit switch detecting the presence of said carriage and outputting a limit signal to said carriage processor indicating position of said carriage.

2. The mechanism of claim 1, wherein said detector is a proximity detector positioned adjacent said wheel.

3. The mechanism of claim 2, wherein said mark is a magnet disposed on said wheel.

4. The mechanism of claim 3, wherein said magnet is disposed on the circumference of said wheel.

5. The mechanism of claim 1, wherein said carriage processor is configured to reset the position of said carriage in response to said limit signal.

6. The mechanism of claim 1, wherein said track has a first end and a second end and wherein said at least one limit switch includes a first limit switch having a first limit signal and a second limit switch having a second limit signal, said first limit switch being disposed at said first end, said second limit switch being disposed at said second end, and said first and second limit signals indicating to said carriage processor whether said carriage is adjacent said first end or said second end.

7. The mechanism of claim 1 wherein said carriage processor includes a central processing unit.

8. The mechanism of claim 1 wherein said mark is a hole through said wheel and said detector further comprises a light source adjacent said wheel for outputting a light signal through said hole, and a light sensor positioned to detect said light signal passing through said hole.

* * * * *